US007343229B1

(12) United States Patent
Wilson

(10) Patent No.: US 7,343,229 B1
(45) Date of Patent: Mar. 11, 2008

(54) METHOD AND APPARATUS FOR DYNAMIC TAXI PATH SELECTION

(75) Inventor: John G. Wilson, West Linn, OR (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 625 days.

(21) Appl. No.: 10/901,467

(22) Filed: Jul. 28, 2004

(51) Int. Cl.
*G06G 7/76* (2006.01)
*G06G 5/06* (2006.01)

(52) U.S. Cl. ..... 701/15; 701/1; 701/3; 340/951

(58) Field of Classification Search ..... 701/1, 701/3, 14–16, 117–120; 244/183; 340/972, 340/979, 958, 951; 362/559
See application file for complete search history.

(56) References Cited

U.S. PATENT DOCUMENTS

| | | | | |
|---|---|---|---|---|
| 6,246,342 | B1 * | 6/2001 | Vandevoorde et al. | 340/961 |
| 6,751,545 | B2 * | 6/2004 | Walter | 701/120 |
| 6,789,010 | B2 * | 9/2004 | Walter | 701/120 |
| 2004/0006412 | A1 * | 1/2004 | Doose et al. | 701/10 |

* cited by examiner

*Primary Examiner*—Yonel Beaulieu
(74) *Attorney, Agent, or Firm*—Nathan O. Jensen; Kyle Eppele

(57) ABSTRACT

A method and apparatus for selecting a taxi path by one or more acceptable taxi paths according to a taxi destination. A primary taxi path is selected according to an operation parameter and is made available as an aeronautical pilot aide.

20 Claims, 11 Drawing Sheets

METHOD AND APPARATUS FOR DYNAMIC TAXI PATH SELECTION

BACKGROUND

Each and every year, airport traffic continues to increase. As the volume of aircraft arriving and departing at an airport increases, the one resource that stands out as a bottle neck is the airport runway. When an aircraft prepares to depart, it typically requires authorization from a control authority (e.g. a control tower). The control authority permits an aircraft to use the runway as soon as the runway becomes available. Inbound aircraft are typically staggered in time to allow outbound aircraft an opportunity to use the runway. When an inbound aircraft touches down, it is important to clear the runway as quickly as possible so as to provide additional availability of this precious airport resource.

Aircraft pilots are bombarded with information provided by onboard instrumentation. In addition to all of this onboard information, an aircraft pilot must maintain cognizance with respect to the position of the aircraft relative to the runway, aircraft speed, weather conditions and many other operational parameters. Most importantly, the aircraft pilot is still responsible for the safe arrival of the aircraft beginning with a landing sequence through arrival at a passenger gate. It should be noted that not all aircraft are destined to arrive at a passenger gate. For example, aircraft can be directed to a fuel station, maintenance hangar or other logistical support facility.

Clearing an arriving aircraft from a runway requires immediate discretion on behalf of a pilot in order to select a runway egress. In order to select a runway egress, a pilot first needs to know the destination to which the aircraft must taxi. Accordingly, the pilot needs to be aware of all of the runway egresses available at a particular airport. The pilot also needs to quickly ascertain which of the available runway egresses are acceptable in order to accommodate a particular taxi destination. For example, if a particular taxi destination is situated east of a runway, there is little benefit in using a westbound runway egress.

Selection of a particular runway egress continues to be a function of numerous operational parameters. For example, a particular runway egress may not be acceptable if the aircraft is moving forward at an exaggerated speed. In fact, the turn angle of a runway egress may be one factor that can be used in conjunction with the speed of the aircraft as a runway egress selection is made. As can be appreciated, selection of a particular runway egress is typically based on numerous operational parameters. What makes the problem worse is that many of the operational parameters are dynamic in nature. Consider, for example, that the turn angle of a runway egress may have differing safe speed criteria depending upon the weight of an aircraft and depending on the surface conditions of the runway and an adjoining taxi path.

Consistent with the goal of quickly clearing a runway, a pilot needs to make a selection of a particular runway egress as quickly as possible. Unfortunately, a pilot may not be able to effectively predict dynamic acceptance criteria for a particular runway egress. As such, a pilot may need to refrain from selecting a runway egress until operational parameters and acceptance criteria can be confidently ascertained. As a result, the pilot may not select the earliest, safe egress opportunity.

SUMMARY

A method and apparatus for selecting a taxi path from one or more acceptable taxi paths according to a taxi destination. A primary taxi path is selected according to an operational parameter and is made available as an aeronautical pilot aide.

BRIEF DESCRIPTION OF THE DRAWINGS

Several alternative embodiments will hereinafter be described in conjunction with the appended drawings and figures, wherein like numerals denote like elements, and in which.

DETAILED DESCRIPTION

Figure 1:
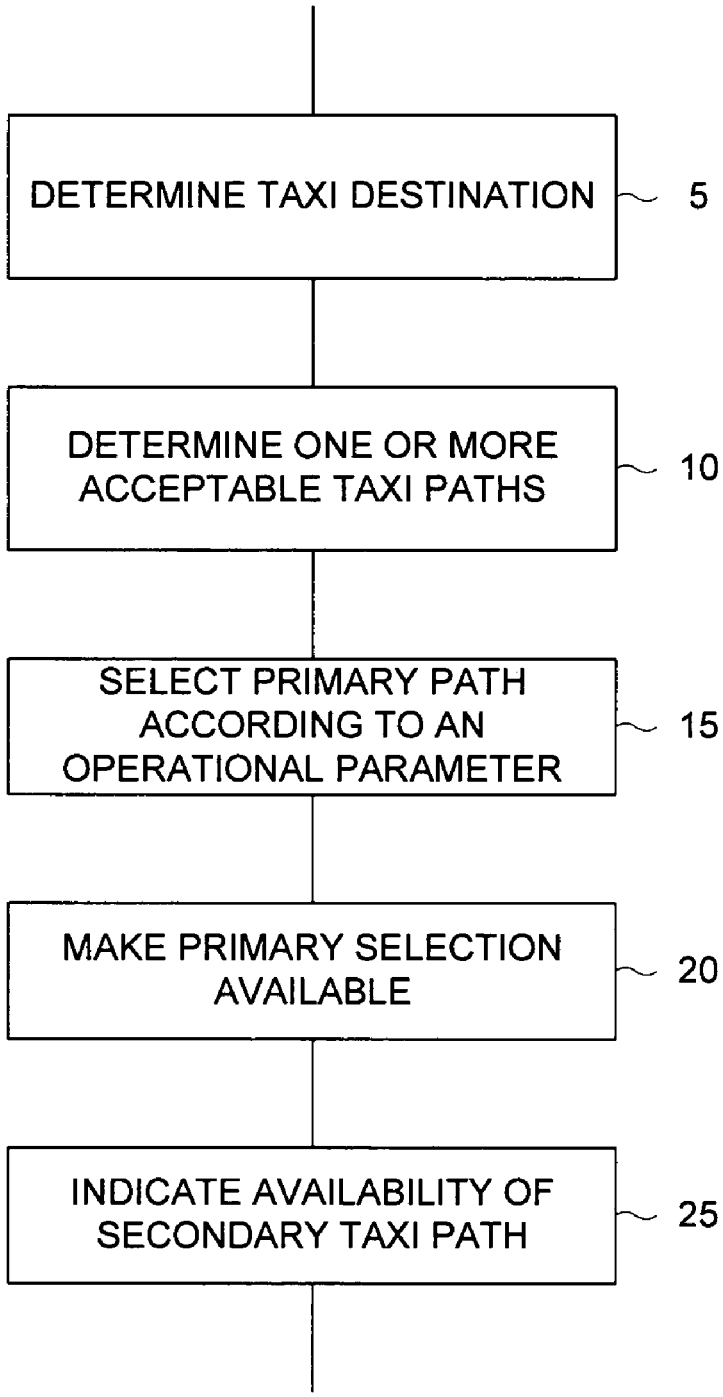
FIG. 1 is a flow diagram that depicts one example method for selecting a taxiway.

FIG. 1 is a flow diagram that depicts one example method for selecting a taxiway. According to this example method, a taxi destination for an aircraft is first determined (step 5). Using the taxi destination as one selection criteria, one or more acceptable taxi paths are determined (step 10). For example, if an aircraft is destined for a passenger terminal west of a runway, this criterion can be used to select one or more runway egresses that lead westward from the runway. As can be appreciated, there exist a wide variety of selection criteria that can be applied in the present method, and any example presented herein is not indented to limit the scope of the appended claims.

Once one or more acceptable taxi paths are determined, a primary path is then selected according to an operational parameter (step 15). Various types of operational parameters can be used as selection criteria as further discussed infra. The selected primary taxi path is then made available (step 20). According to one variation of the present method, the availability of a second taxi path selection is also indicated (step 25). According to this variation of the present method, when a second taxi path selection is available, a pilot can choose not to accept a first selected taxi path in deference to a second taxi path that is available further down the runway.

Figure 2:
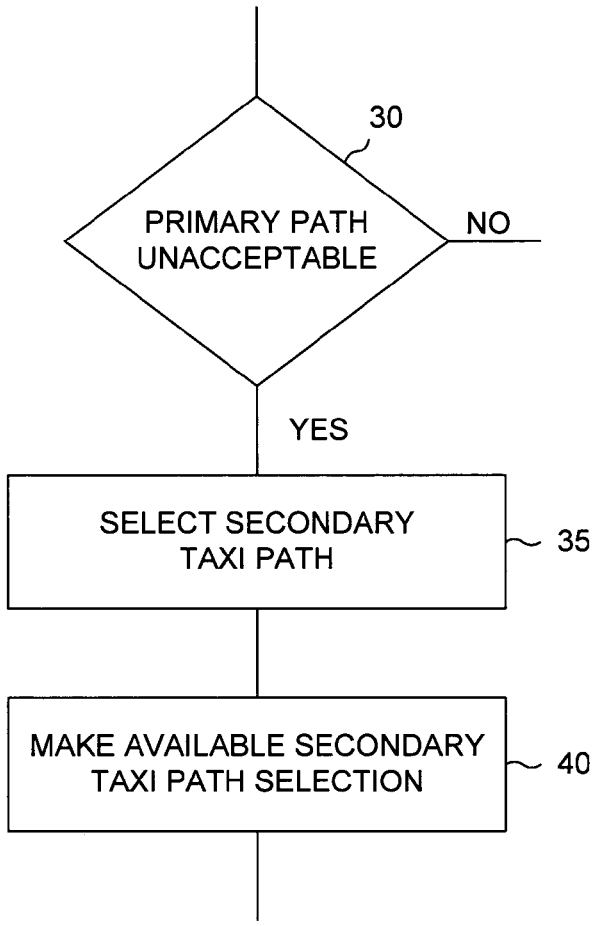
FIG. 2 is a flow diagram that depicts an alternative method wherein a secondary taxi path is selected.

FIG. 2 is a flow diagram that depicts an alternative method wherein a secondary taxi path is selected. According to this alternative method, a primary taxi path may become unacceptable as one or more operational parameters vary (step 30). In the case where a primary taxi path becomes unacceptable, a secondary taxi path is selected (step 35). The secondary taxi path selection is then made available (step 40). According to one illustrative use case, as an aircraft proceeds down a runway an operational parameter may change rendering a previously selected primary taxiway as unacceptable. For example, the speed of an aircraft may still be excessive at a particular position along the runway in order to utilize a primary taxi path selection. In such case, the primary selection of a taxi path becomes unacceptable. According to another example, the aircraft may have proceeded down a runway to such a point where a taxi path selected as a primary alternative can no longer be used, i.e. the aircraft is simply too far down the runway to safely take a particular runway egress.

Figure 3:
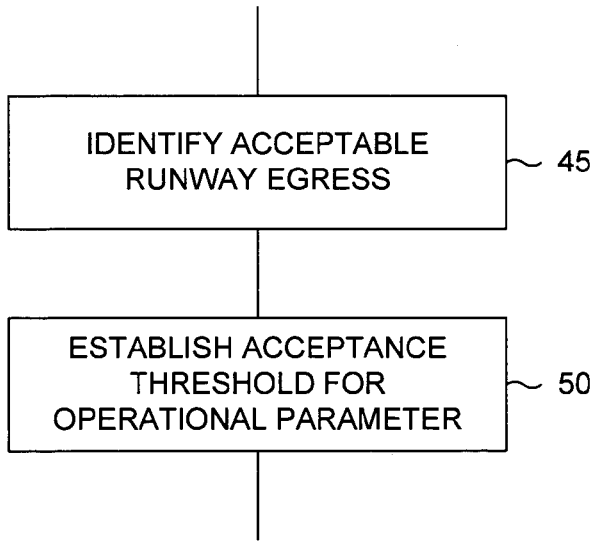
FIG. 3 is a flow diagram that depicts one example method for determining one or more acceptable taxi paths.

FIG. 3 is a flow diagram that depicts one example method for determining one or more acceptable taxi paths. According to this example method, an acceptable taxi path is determined by identifying an acceptable runway egress according to a taxi destination (step 45). As already discussed, if a taxi destination is west of the runway, a runway egress that leads to west from the runway may be more preferable to any egress that leads east from the runway. It should be noted that a wide variety of selection criterion can be used to determine the acceptability of an egress and any examples herein provided for illustrative purposes in not intended to limit the scope of the claims appended hereto. For every taxi path that is determined to be acceptable, this example method provides for establishing an accepted threshold for one or more operational parameters (step 50). An acceptance threshold, according to one variation of the present method, is established for at least one of several operational parameters including but not limited to aircraft position, aircraft speed, aircraft center of gravity, aircraft braking performance, aircraft weight, aircraft turning radius, aircraft touch-down position, turn angle of runway egress, surface condition of runway, surface condition of taxi way, airline directives, passenger comfort, visibility, weather and position of surface traffic.

According to one variation of the present method, aircraft position relative to a runway can be used as a basis for selecting a particular runway egress. According to this example variation, a particular runway egress will have associated with it a final acceptance threshold for aircraft position. Accordingly, if an aircraft proceeds down a runway beyond this final acceptance threshold, a particular egress would become unacceptable. According to yet another variation of the present method, the speed of an aircraft can be used as the basis for selecting a particular runway egress. Accordingly, an acceptance threshold for aircraft speed can be established for a particular egress. The aircraft speed acceptance threshold for a particular egress, according to one variation of the present method, can itself the based on other operational parameters. For example, the maximum speed of an aircraft for any particular egress from a runway can be based on other operational parameters such as the weight of the aircraft and passenger comfort. In this example variation of the present method, the weight of the aircraft and passenger comfort (expressed in terms of experienced G-force) can be used in conjunction with a turn angle of a runway egress to determine a maximum operational speed for that particular runway egress. These example variations of the present method are presented herein to illustrate and are not intended to limit the scope of the claims appended hereto. One feature of the present method is that of using known physical attributes of the aircraft, the surrounding environment and other operational parameters as a basis for establishing an acceptance threshold for a particular runway egress. As such, these physical attributes of the aircraft, the surrounding environment and other operational parameters can be combined according to known methods to establish an acceptance threshold for a particular runway egress.

Figure 4:
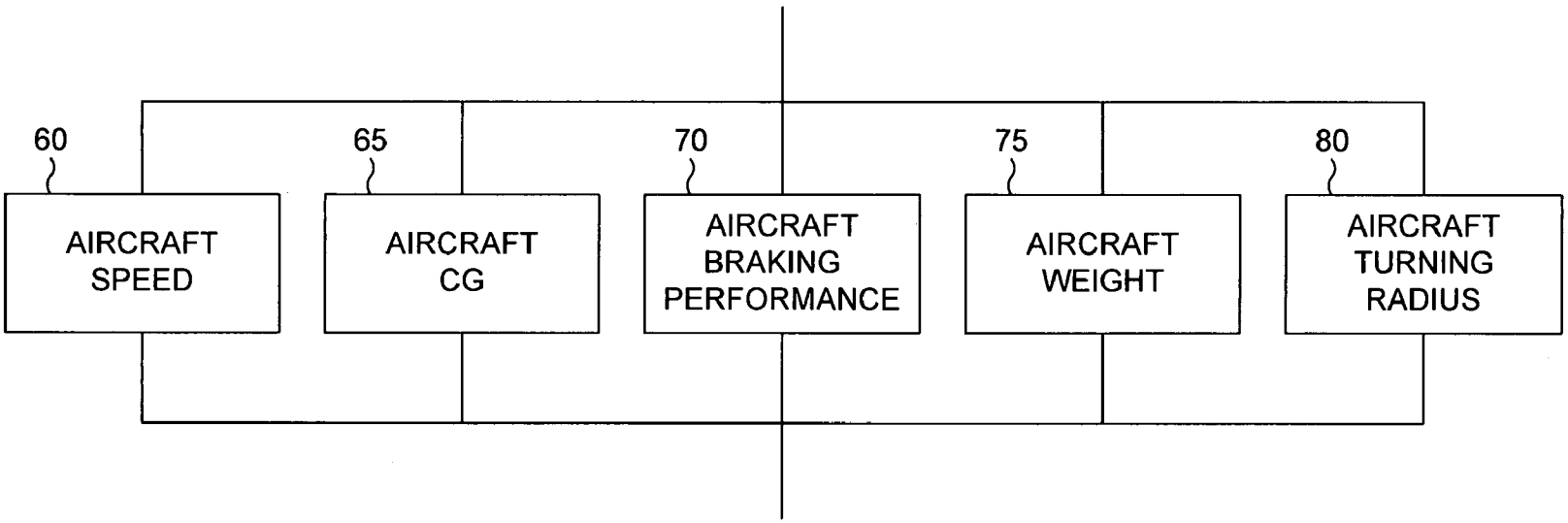
FIG. 4 is a flow diagram that depicts several alternative methods for selecting a primary taxi path according to aircraft attributes.

FIG. 4 is a flow diagram that depicts several alternative methods for selecting a primary taxi path according to aircraft attributes. Once an acceptance threshold for a particular operational parameter for a particular runway egress is established, a taxi path is selected according to a corresponding operational parameter. For example, aircraft speed (step 60) is used as a basis for selection in one variation of the present method. According to one alternative variation of the present method, a taxi path is selected according to aircraft center of gravity (CG) (step 65). According to yet another alternative variation of the present method, the braking performance (step 70) of an aircraft is used as a basis for selecting a taxi path. In yet another alternative variation of the present method, the weight of an aircraft is used as a selection criterion for a taxi path (step 75). The turning radius of an aircraft is used in yet another alternative variation of the present method (step 80) for selecting a taxi path. In order to select a particular runway egress, these alternative methods provide for comparison of an aircraft attribute or operational parameter with an acceptance threshold for the corresponding aircraft attribute or operational parameter.

Figure 5:
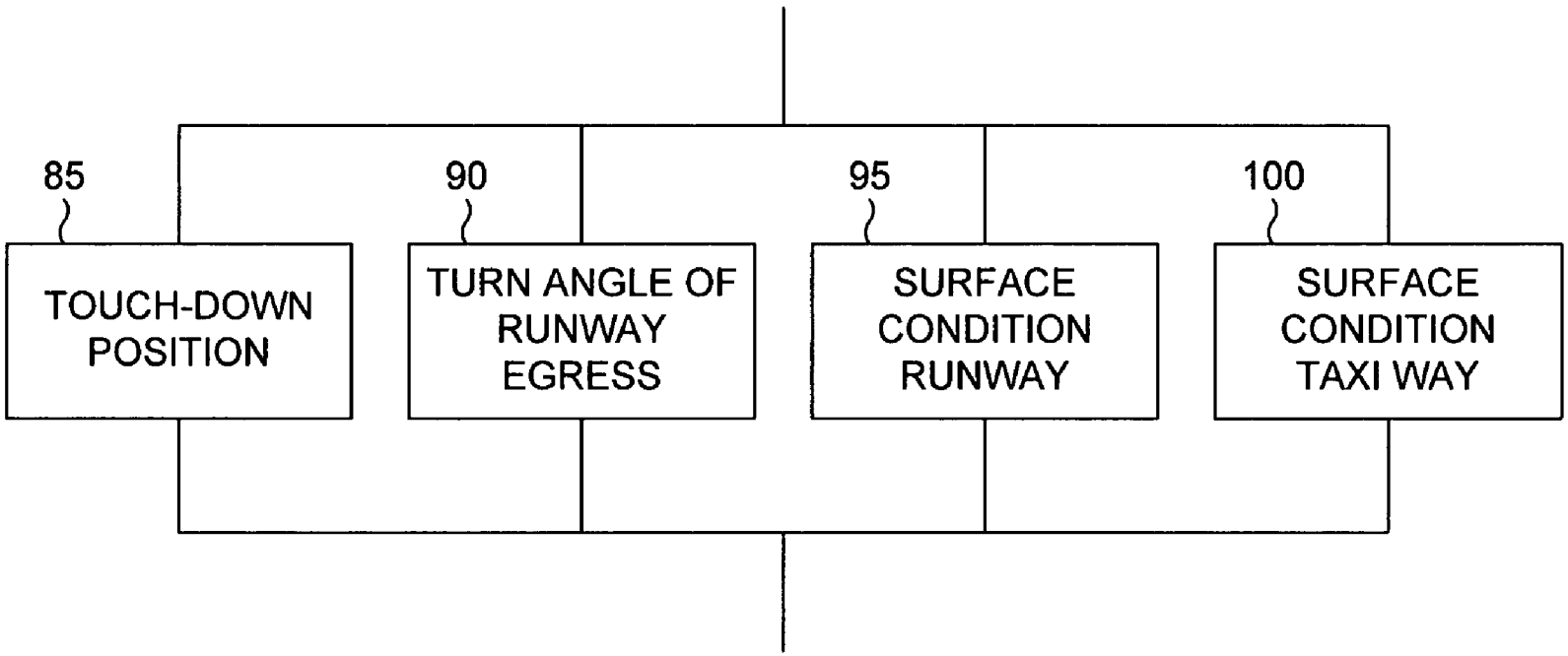
FIG. 5 is a flow diagram that depicts several alternative methods for selecting a taxiway.

FIG. 5 is a flow diagram that depicts several alternative methods for selecting a taxiway. According to one variation of the present method, the position that an aircraft touches down on a runway (step 85) is used as a basis for selecting a primary taxi path. According to yet another variation of the present method, the turn angle of a runway egress (step 90) is used as a basis for selecting a primary taxi path. The surface condition of a runway (step 95) and the surface condition of a taxiway (step 100) are used in corresponding alternative variations of the present method for selection of a primary taxi path.

Figure 6:
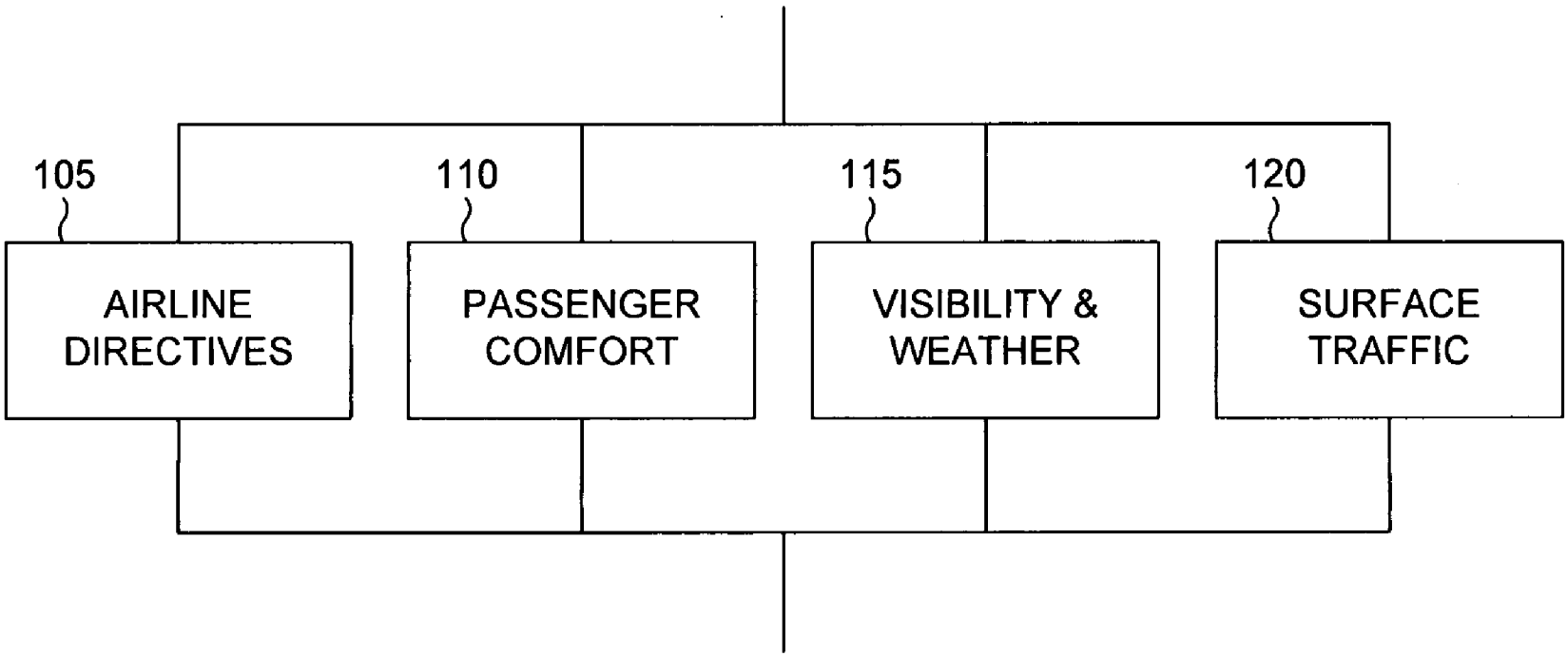
FIG. 6 is a flow diagram that depicts several other alternative methods for selecting a taxiway.

FIG. 6 is a flow diagram that depicts several other alternative methods for selecting a taxiway. According to one illustrative variation of the present method, airline directives (step 105) are used as a basis for selecting a primary taxi path. Airline directives can include, but are not necessarily limited to maximum lateral G-force, maximum braking deceleration, airline terminal location and maximum taxi distance. Passenger comfort (step 110) is used as a basis for selecting a primary taxi path according to yet another variation of the present method. Passenger comfort can include a maximum G-force that a passenger should be subjected to as an aircraft egresses from a runway. Visibility and other weather related factors (step 115) are used according to one alternative variation of the present method for selecting a primary taxi path. Surface traffic (step 120) proximate to the runway or present at other locations in an airport are used according to one alternative variation of the present method to select a primary taxi path. For example, a fuel truck disposed along a particular taxi path may cause that particular taxi path to be unacceptable.

Figure 7:
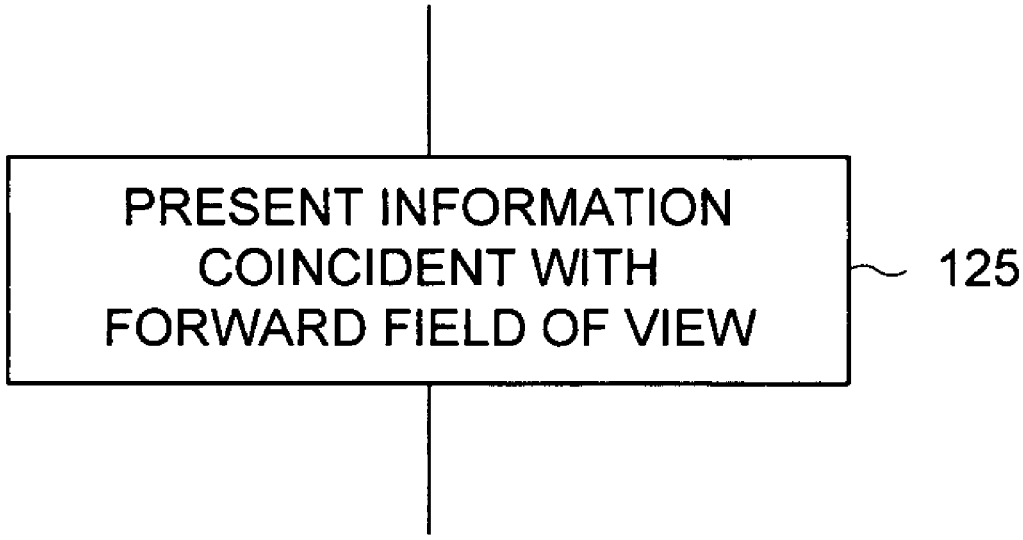
FIG. 7 is a flow diagram that depicts one alternative method for making a selected primary taxi path available.

FIG. 7 is a flow diagram that depicts one alternative method for making a selected primary taxi path available. According to this alternative method, a selected primary taxi path is made available by presenting information coincidentally with a forward field of view relative to an aircraft pilot (step 125). According to one alternative method, this is accomplished by presenting information on a "heads-up" display.

Figure 8:
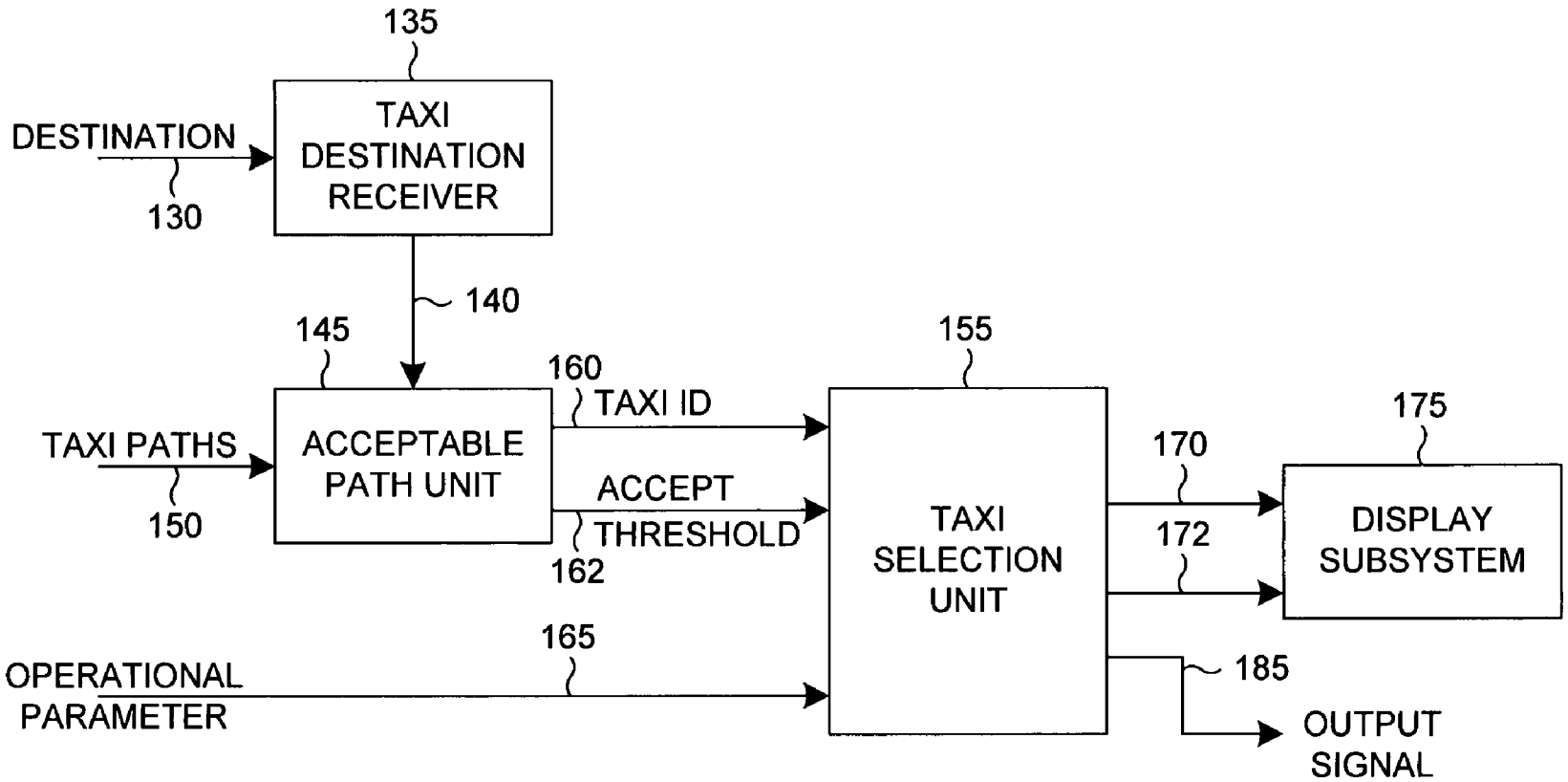
FIG. 8 is a block diagram of one example embodiment of a dynamic taxi path unit.

FIG. 8 is a block diagram of one example embodiment of a dynamic taxi path unit. According to this example embodiment, a dynamic taxi path unit comprises a taxi destination receiver 135, an acceptable path unit 145, a taxi selection unit 155 and an output interface 185. The taxi destination receiver 135 of this example embodiment is capable of receiving a taxi destination 130. A taxi destination 130 can, for example, be expressed in spatial coordinates. A taxi destination 130 can include, but is not necessarily limited to a particular passenger terminal, a particular passenger gate, a fuel station, a maintenance hangar and any logistical support facility. One example of a logistical support facility includes a freight terminal. Another example of a logistical support facility includes a lavatory service facility. All of these examples of taxi destinations are presented herein to illustrate and are not intended to limit the scope of the claims appended hereto.

In operation, the taxi destination receiver 135 receives a taxi destination 130 and generates a taxi destination identifier 140 according to the received taxi destination 130. The taxi destination identifier 140 is conveyed to the acceptable path unit 145. The acceptable path unit 145 receives one or more taxi path descriptors 150. A taxi path descriptor 150, according to one illustrative embodiment, is expressed in terms of spatial coordinates for a start location and an end location. The acceptable path unit 145 uses the taxi destination identifier 140 as one selection criterion for selecting one or more of the taxi path descriptors 150 received by the acceptable path unit 145.

The acceptable path unit 145 generates a taxi path identifier 160 and an acceptance threshold 162 for an acceptable taxi path selected from one or more taxi path descriptors 150. An acceptable taxi path is selected according to the taxi destination identifier 140 that the acceptable path unit 145 receives from the taxi destination receiver 135. A taxi path identifier 160 for an acceptable taxi path, together with a corresponding acceptance threshold 162, is conveyed to the taxi selection unit 155. The taxi selection unit 155 selects a primary taxi path from one or more acceptable taxi paths according to an operational parameter 165. It should be noted that, according to one alternative illustrative embodiment, the acceptable path unit 145 generates one or more acceptance thresholds corresponding to one or more operational parameters. For example, if there are three operational parameters used in one non-limiting illustrative embodiment to select a taxi path, the acceptable path unit 145 of such an illustrative example embodiment will generate three acceptance thresholds. Accordingly, the taxi selection unit 155 will use some combination of acceptance thresholds to select a primary taxi path by subjecting corresponding operational parameters to the acceptance thresholds. Once a primary taxi path has been selected, it can be conveyed as an output signal by means of the output interface 185. According to one alternative embodiment, a primary taxi path selection 172 is conveyed to a display subsystem 175 and is included in this alternative embodiment of a taxi path selection unit.

According to yet another alternative embodiment, the taxi selection unit 155 selects a secondary taxi path according to a change in an operational parameter 165. According to one alternative embodiment, the taxi selection unit 155 provides the secondary taxi path selection as an output signal via the output interface 185. In yet another alternative embodiment, the taxi selection unit 155 provides the secondary taxi path selection 172 to a display subsystem 175 included in this alternative embodiment.

According to yet another alternative embodiment, the taxi selection unit 155 provides an indication of whether or not a secondary taxi path selection is available. This indication is available as an output signal conveyed by means of the output interface 185. In one alternative embodiment, an implicit indication of the availability of a secondary taxi path selection can be made by monitoring the state of the secondary taxi path selection output 172 provided by the taxi selection unit 155. For example an inference can be made that no additional selection is available when the secondary taxi path selection output 172 remains quiescent.

Figure 9:
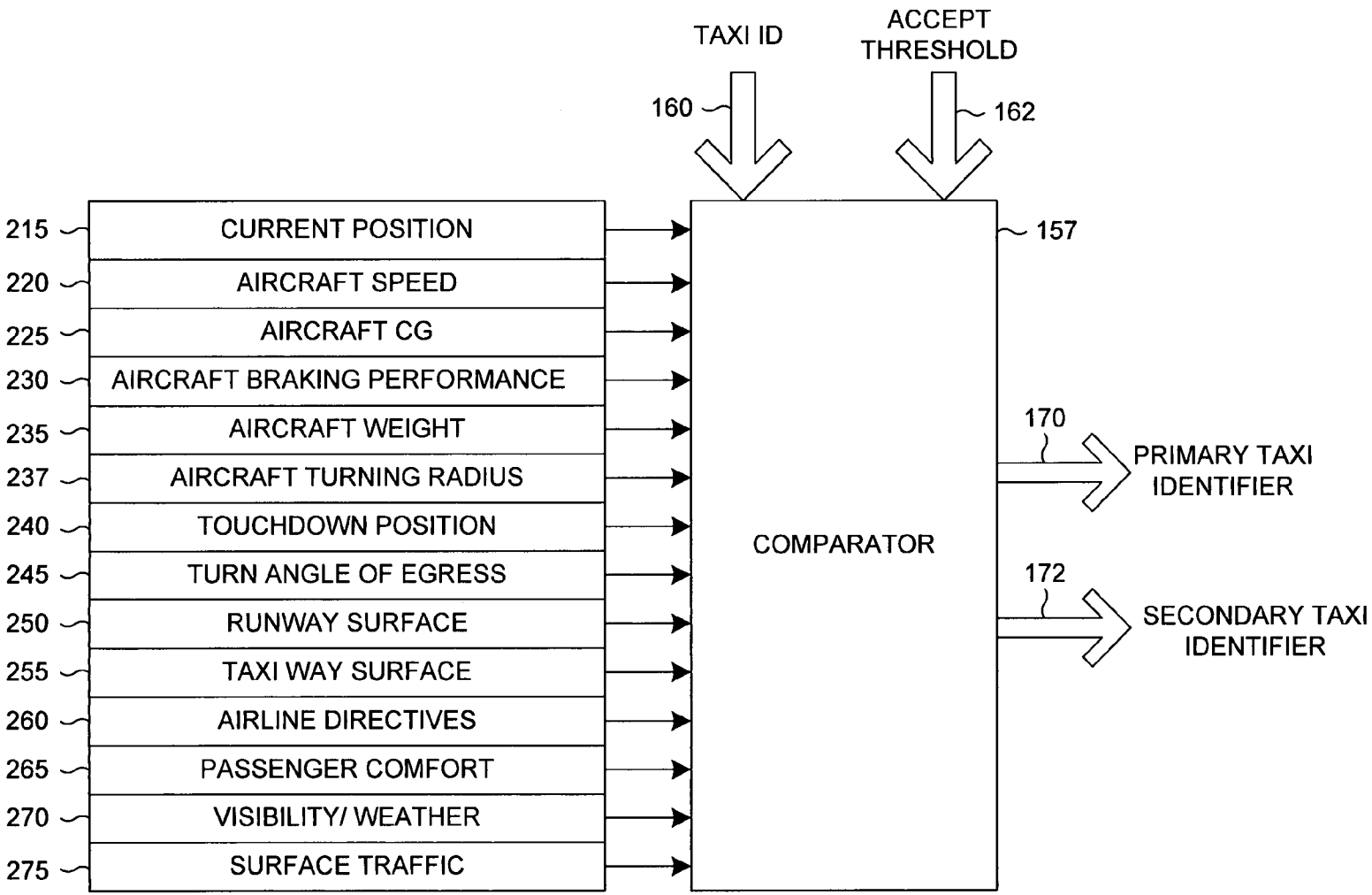
FIG. 9 is a block diagram of one example embodiment of a taxi selection unit.

FIG. 9 is a block diagram of one example embodiment of a taxi selection unit. According to the example embodiment of a taxi selection unit 155 (introduced in FIG. 8), the taxi selection unit 155 includes a comparator 157. According to this example embodiment, the comparator 157 compares an operational parameter against a corresponding acceptance threshold 162 received from the acceptable path unit 145. According to this comparison, the comparator 157 accepts a taxi identifier 160 and stores this as a primary taxi path selection when the operational parameter is within the corresponding acceptance threshold. According to one alternative example embodiment, the comparator 157 further includes a plurality of registers for storing a taxi identifier 160 and a corresponding acceptance threshold 162 for a plurality of acceptable taxi paths provided by the acceptable path unit 145. According to yet another alternative example embodiment, there are a plurality of registers included in the comparator 157 for storing a plurality of acceptance thresholds for each taxi path identifier 162 provided by the acceptable path unit 145. It should be noted that a particular taxi path identifier may have a plurality of acceptance thresholds corresponding to a plurality of operational parameters upon which a selection of a taxi path is based. According to this alternative embodiment, a state machine included in the comparator 157 subjects each operational parameter to a corresponding acceptance threshold 162 for a particular taxi identifier 160. Accordingly, when each of the operational parameters is within its corresponding acceptance threshold, a taxi identifier 160 associated there with is selected as a primary taxi identifier 170.

According to one alternative embodiment, the comparator 157 included in the taxi selection unit 155 compares position of an aircraft 215 against an acceptance threshold 162 for a particular taxi identifier 160. In this alternative embodiment, the acceptance threshold 162 pertains to a position of an aircraft relative to a particular runway egress. According to yet another alternative embodiment, the comparator 157 included in the taxi selection unit 155 compares aircraft speed 220 against an acceptance threshold 162 that represents a maximum egress speed for a particular runway egress. According to yet another alternative embodiment, the comparator 157 included in the taxi selection unit 155 compares an aircraft center of gravity against an acceptance threshold 162. According to this alternative embodiment, the acceptance threshold 162 pertains to a maximum center of gravity position along the longitudinal axis of the aircraft relative to a runway egress. In yet another illustrative embodiment, the comparator 157 compares minimum aircraft braking performance 230 against acceptance threshold 162. In this case, an aircraft that does not satisfy the minimum braking performance within a particular position relative to an egress from a runway will not be advised to use that particular egress as either a primary or secondary taxi path. In an additional alternative illustrative embodiment, the weight of an aircraft 235 is compared against an acceptance threshold 162 representative of the maximum distance from a runway egress an aircraft of a particular weight is traveling a particular speed.

FIG. 9 further illustrates that, according to yet another alternative embodiment, the comparator 157 included in the taxi selection unit 155 compares an aircraft turning radius 237 against an acceptance threshold 162 indicative of the turning radius required by a particular runway egress. In yet another alternative example embodiment, the comparator 157 compares an aircraft touchdown position 240 against the position of a particular runway egress received as an acceptance threshold 162 from the acceptable path unit 145 for a particular taxi identifier 160. The turn angle 245 for a particular runway egress is compared against an acceptance threshold 162 by the comparator 157 in yet an additional alternative embodiment of a taxi selection unit 155. In this case, the turn angle 245 may be used in conjunction with aircraft speed and passenger comfort 265 as a basis for identifying a primary or secondary taxi path. However, the turn angle 245 for a particular runway egress, according to yet another alternative embodiment, is used singularly as a selection criterion.

In yet another alternative embodiment, the comparator 157 compares at least one of a runway surface condition indicator 250 and a taxiway surface condition indicator 255 against corresponding acceptance thresholds 162 for a particular taxi identifier 160 received from the acceptable path unit 145. According to this alternative embodiment, the surface condition of a runway or a taxiway is expressed as a percentage of static friction ordinarily associated with ideal conditions of said surfaces. According to yet another alternative embodiment, the comparator 157 included in the taxi selection unit 155 receives an operational parameter in the form of visibility and/or weather indicators 270. According to yet another example embodiment, a visibility indicator is received in the form of visibility distance (e.g. as expressed in feet). According to yet another example embodiment, a weather indicator is received in the form of a weather index. Such a weather index may correspond to a particular type of weather. For example, an index of "0" can be used to indicate perfect weather conditions. As weather conditions worsen, the index can increase to indicate the severity of current weather conditions. A particular runway egress (and by implication a particular taxi path), according to one illustrative example embodiment, is selected when a visibility indicator and/or a weather indicator is within a corresponding acceptance threshold 162. Accordingly, a primary taxi identifier 170 is provided by the comparator 157 upon this condition. A secondary taxi identifier 172, in yet another alternative embodiment, is provided when the primary taxi identifier is representative of a taxi path that becomes unacceptable. It should be noted that a secondary taxi identifier 172 can be provided while the primary taxi identifier 170 represents a taxi path that continues to be acceptable.

FIG. 9 further illustrates that, according to yet another alternative embodiment, the comparator 157 receives an operational parameter in the form of an airline directive 260. An airline directive includes, but is not necessary limited to maximum lateral G-force, maximum braking deceleration, airline terminal location and maximum taxi distance. According to one example embodiment, an airline directive is received in the form of an operational index. As such, an operational index can have varying degrees of acceptability in terms of selection of a taxi path. For example, consider a situation where a first operational index corresponds to a first type of airline directive. It follows that a second operational index corresponds to a second type of airline directive. In each of these examples, the first operational index will correspond to a less stringent operational strategy for an aircraft. As the value of the operational index rises, this example embodiment provides for more stringent operational guidelines and accordingly would limit selection of acceptable taxi paths. According to one example embodiment, an airline directive can include a passenger comfort index 265. This type of operational parameter is typically received as an index representing the maximum amount of G-force an airline passenger should be subjected to. As such, a particular taxi path identifier 160 will have a corresponding acceptance threshold 162 for a passenger comfort 265 operational parameter. According to this example embodiment, the comparator 157 will propagate as a primary taxi identifier 170 a taxi path identifier 160 when a passenger comfort 265 operational parameter is within a corresponding acceptance threshold 162.

According to yet another alternative embodiment, the comparator 157 included in the taxi selection unit 155 receives as an operational parameter a surface traffic indicator 275. According to this example embodiment, the surface traffic indicator 275 is expressed in terms of a quantity of surface traffic along a particular taxi path (as identified by the taxi identifier 160 received from the acceptable path unit 145). An acceptance threshold 162 for a particular taxi path identifier 160 is compared against the surface traffic indicator 275 as a selection criterion for a primary taxi identifier 170. Accordingly, the comparator 157 propagates the taxi identifier 160 through to the primary taxi identifier 170 when a successful selection according to the surface traffic operational parameter 275 is detected.

Figure 10:
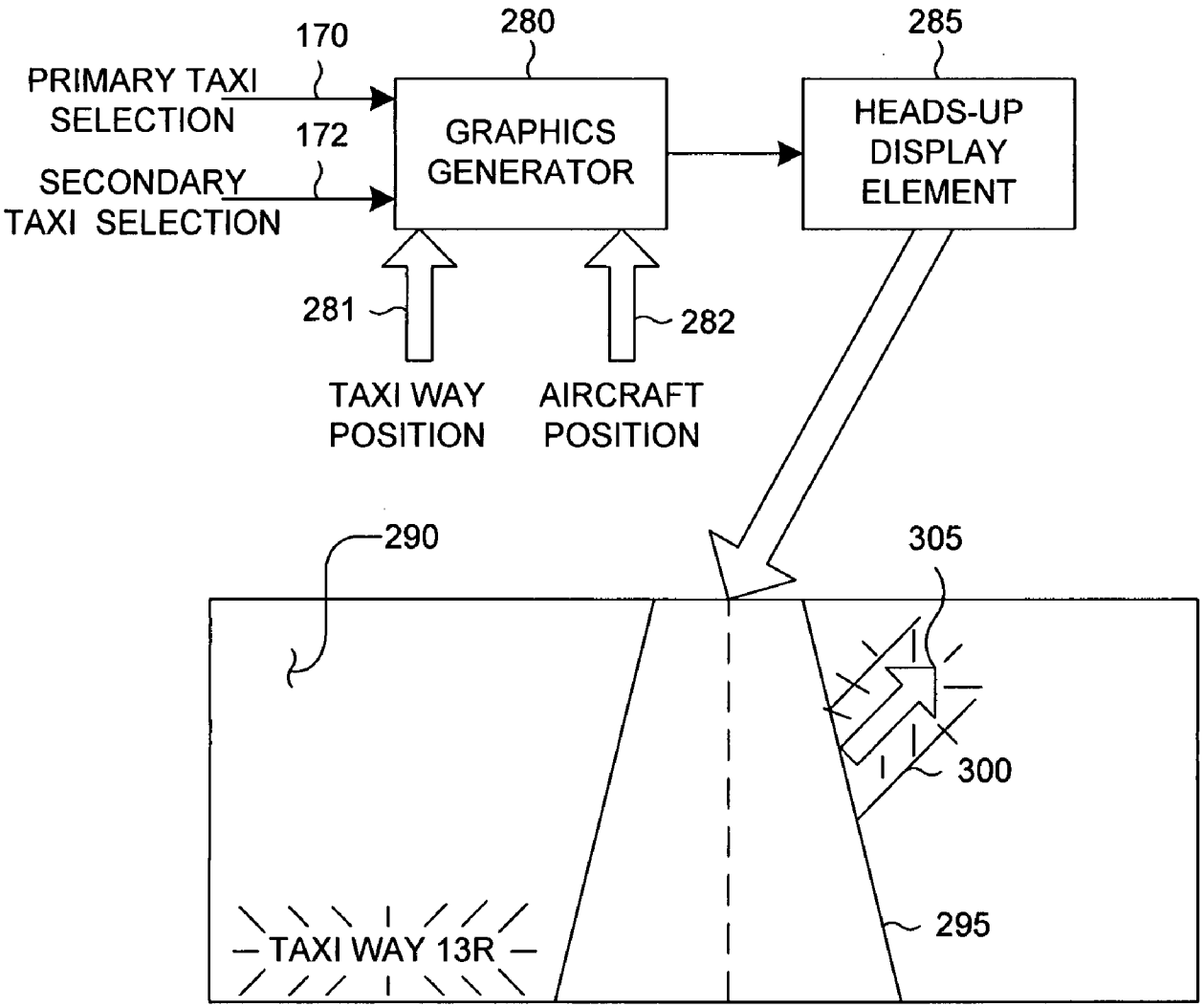
FIG. 10 is a block diagram of one example embodiment of a display system.

FIG. 10 is a block diagram of one example embodiment of a display system. According to this example embodiment, a display subsystem includes a heads-up display 285. According to one alternative example embodiment, the display subsystem further includes a graphic generator 280. According to this alternative embodiment, the graphic generator 280 receives at least one of a primary taxi selection 170 and a secondary taxi selection 172. A primary taxi selection 170 is used to generate an indication of the availability and the actual selection of a primary taxiway. According to one alternative embodiment, the graphic generator 280 generates a signal 283 for driving the heads-up display 285. According to yet another alternative embodiment, the graphic generator 280 receives a taxiway position 281 and a current aircraft position 282. Accordingly, the heads-up display 285 substantially superimposes a primary taxi indicator 305 onto a forward view 290 from an aircraft. For example, the primary taxi indicator 305 can be superimposed substantially over the scene of an actual runway egress 300. The primary taxi indicator 305, according to one alternative embodiment of the graphics generator 280, flashes. According to yet another alternative embodiment, the primary taxi indicator 305 flashes when a secondary taxi selection 172 is not available. Accordingly, when an aircraft operator sees a steady-state primary taxi selection indicator 305, the operator can infer that an additional runway egress is available. However, when the primary taxi indicator 305 flashes, the operator should infer that a secondary taxi selection is not available and that the current primary taxi selection 170 represented by the indicator 305 represents the safest and only currently known taxi path to a taxi destination.

Figure 11:
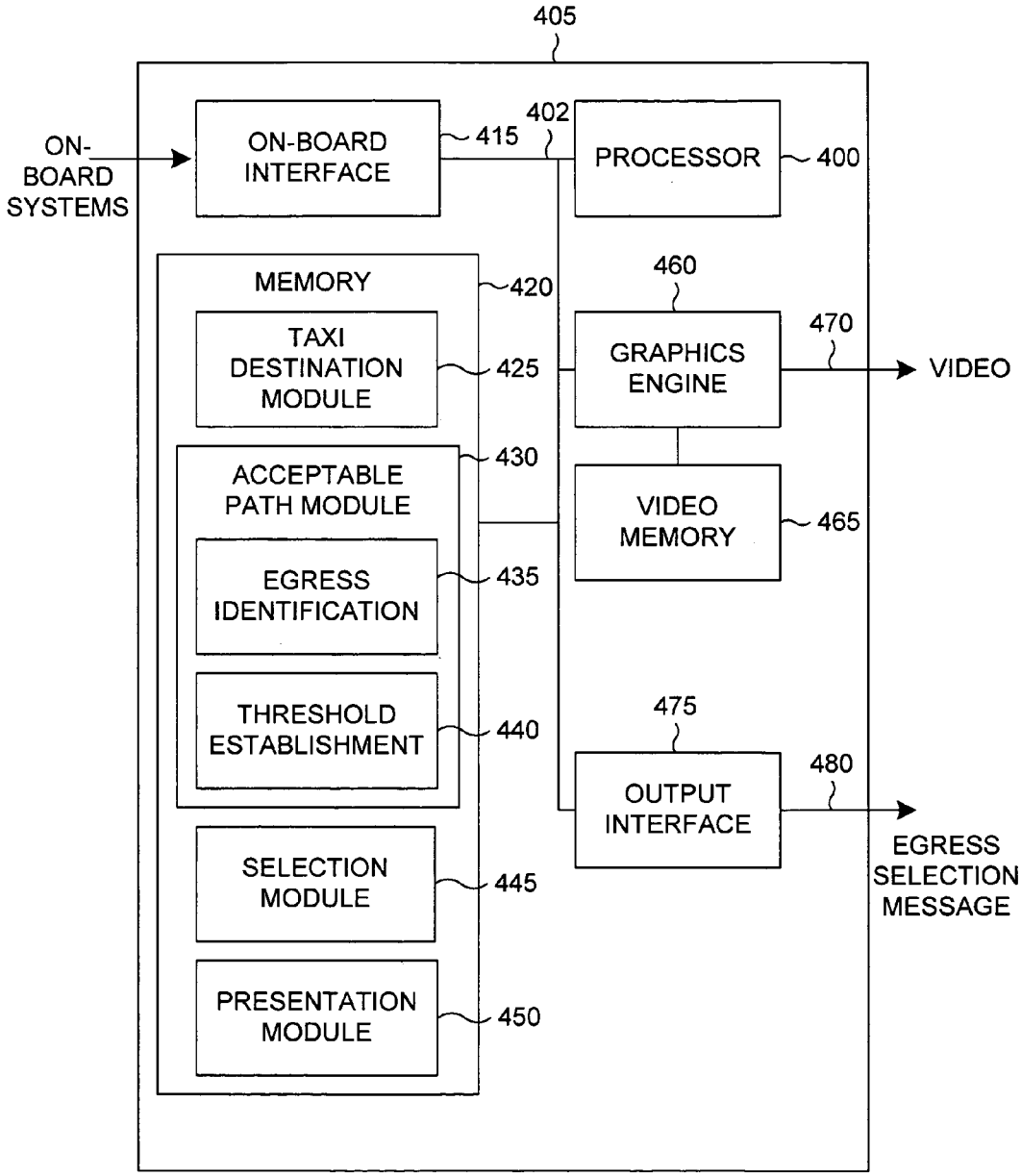
FIG. 11 is a block diagram of one alternative example embodiment of a dynamic taxi unit.

FIG. 11 is a block diagram of one alternative example embodiment of a dynamic taxi unit. According to this alternative embodiment, a dynamic taxi unit 405 comprises one or more processors 400, an onboard interface 415, memory 420 and an output interface 475. Also included in this example embodiment of a dynamic taxi unit 405 are one or more functional modules. A functional module is typically embodied as an instruction sequence. An instruction sequence that implements a functional module, according to one alternative embodiment, is stored in the memory 420. The reader is advised that the term "minimally causes the processor" and variants thereof is intended to serve as an open-ended enumeration of functions performed by the processor 400 as it executes a particular functional module (i.e. instruction sequence). As such, an embodiment where a particular functional module causes the processor 400 to perform functions in addition to those defined in the appended claims is to be included in the scope of the claims appended hereto.

According to one example embodiment, there are included in the memory 420 a taxi destination module 425, an acceptable path module 430, a selection module 445 and a presentation module 450. According to yet another alternative embodiment, the acceptable path module 430 includes an egress identification module 435 and a threshold establishment module 440. In yet another alternative example embodiment, a dynamic taxi path unit 405 includes a graphics engine 460 that generates a video signal 470 according to information stored in a video memory 465. All of said features are communicatively associated with each other by a bus 402.

Figure 12:
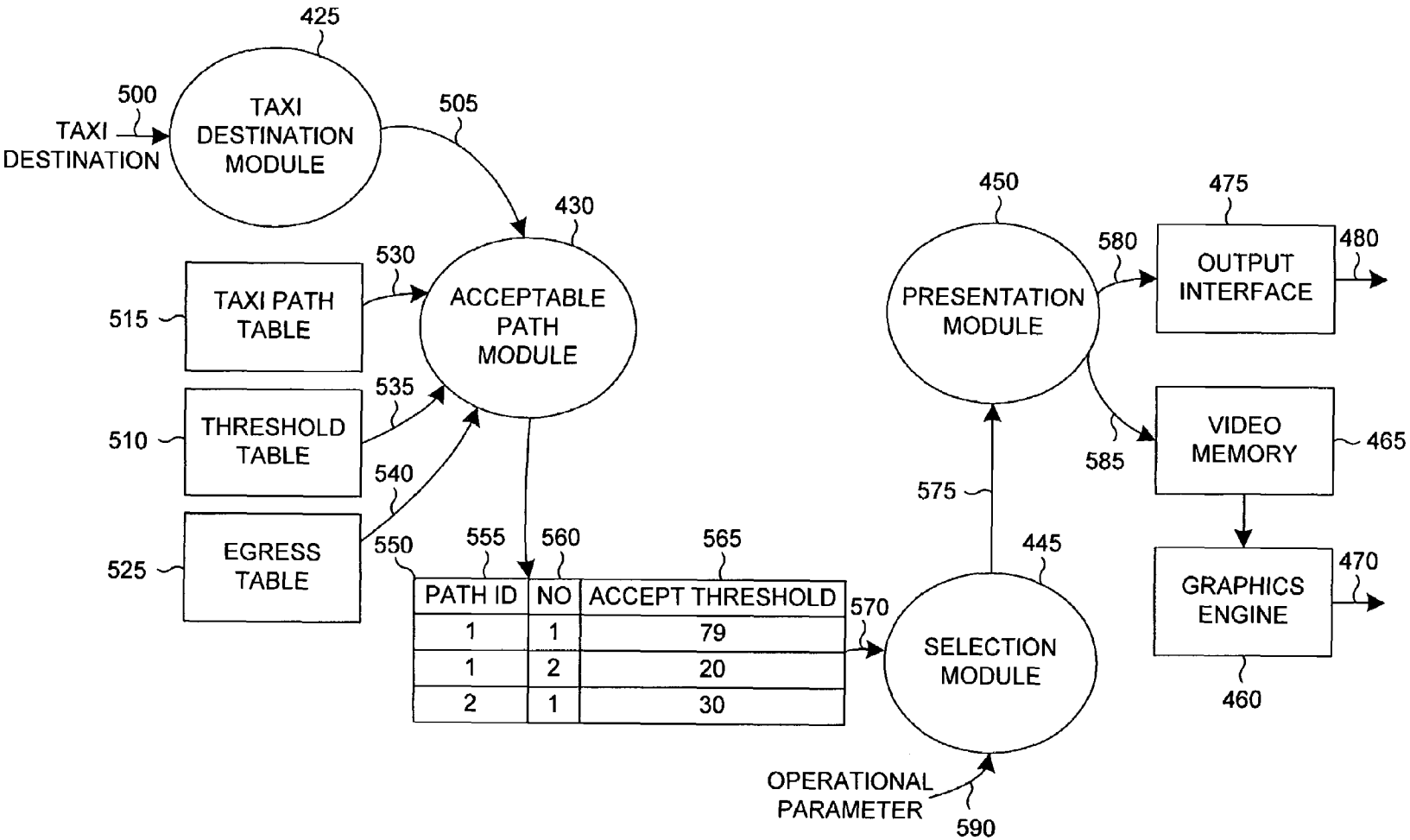
FIG. 12 is a data flow diagram that depicts the internal operation of one example embodiment of a dynamic taxi path unit.

FIG. 12 is a data flow diagram that depicts the internal operation of one example embodiment of a dynamic taxi path unit. According to this example embodiment, the processor 400 executes the taxi destination module 425 stored in the memory 420. When executed by the processor 400, the taxi destination module 425 minimally causes the processor 400 to receive a taxi destination 500. The taxi destination 500, according to various illustrative embodiments, is received in the form of coordinates that specify a particular taxi destination. In accordance with the teachings of the present method, the taxi destination 500 can specify a particular destination including, but not limited to a passenger terminal, a passenger gate, a maintenance hangar and logistical support facility. The taxi destination 500 need not necessarily be limited to stationary locations. For example, one alternative embodiment of a taxi destination module 425 minimally causes the processor 400 to receive a taxi destination representing a refueling vehicle.

According to yet another alternative embodiment, the taxi destination module 425, when executed by the processor 400, minimally causes the processor 400 to receive a taxi destination 500 from an on-board interface 415 included in this alternative embodiment. The on-board interface 415, in turn, may receive the taxi destination 500 from various sources including, but not limited to an on-aircraft user terminal or a data communications system enabling receipt of the taxi destination 500 from a ground-based source (e.g. a control tower). For example, a control tower can use a wireless system to convey a taxi destination to an aircraft prior to touchdown. The on-board interface 415 included in the dynamic taxi path unit 405 can then convey the taxi destination to the processor 400 as the processor 400 executes the taxi destination module 425.

The processor 400, according to one illustrative example embodiment, further executes the acceptable path module 430. When executed by the processor 400, the acceptable path module 430 minimally causes the processor to determine one or more acceptable taxi paths for a received taxi destination 505. According to one example alternative embodiment, this is accomplished when the acceptable path module 430 minimally causes the processor 400 to consult a taxi path table 515 stored in the memory 420. Accordingly, the processor 400, as it executes the acceptable path module 430 of this alternative embodiment, is minimally caused to correlate the taxi destination 505 with one or more entries in the taxi path table 515. For example, the correlation includes, according to one alternative embodiment, the identification of taxi paths that are situated west of a runway when a particular taxi destination 505 is also west of the runway. It should be noted that various types of correlations can be accomplished by the processor 400 as it executes the acceptable path module 430 and any examples of correlation techniques presented herein are for illustrative purposes only and are not intended to limit the scope of the claims appended hereto.

According to yet another alternative embodiment, the acceptable path module 430, when executed by the processor 400, further minimally causes the processor 400 to establish an acceptance threshold for one or more runway egresses. According to this alternative embodiment, the acceptable path module 430 includes an egress identification module 435 and a threshold establishment module 440. In this alternative embodiment, the egress identification module 435, when executed by the processor 400, minimally causes the processor to identify an acceptable runway egress for a particular taxi destination 505 generated by the processor 400 as it executes the taxi destination module 425. According to one alternative embodiment, the egress identification module 435 minimally causes the processor 400 to correlate with a taxi destination a runway egress enumerated in an egress table 525 included in the memory 420. For any particular egress identified 540 by the processor 400 as it executes the egress identification module 435, the threshold establishment module 440, when executed by the processor 400 minimally causes the processor 400 to determine an acceptance threshold 535 for one or more operational parameters. As a result, the processor 400, as it continues to execute the acceptable path module 430, generates one or more acceptable path descriptors that are stored in a path acceptance table 550 included in the memory 420.

FIG. 12 further illustrates one example embodiment of a path acceptance table 550. According to this example embodiment, a path acceptance table 550 includes several fields amongst which are a path identifier field 555, an operational parameter number 560 and an acceptance threshold 565. When the processor 400 identifies an acceptable path according to a taxi destination, it creates an acceptable path descriptor in the path acceptance table 550. The acceptable path descriptor includes an identifier for a particular taxi path that is stored in the path identifier field 555. The acceptable path descriptor further includes an operational parameter number stored in the operational parameter number field 560. An operational parameter is identified according to an ordinal number according to one alternative embodiment of an acceptable path module 430. For example, an ordinal number of "1" may be used to identify an aircraft position operational parameter. An ordinal number of "2" may be used to identify an aircraft speed operational parameter. However, it should be noted that any suitable means may be employed for identifying a particular operational parameter (e.g. a mnemonic representing a particular operational parameter). None of these examples of ordinals and corresponding operational parameters or the use of a mnemonic is intended to limit the scope of the claims appended hereto. The corresponding acceptance threshold is stored in the acceptance threshold field 565 of an acceptable path descriptor.

According to this example embodiment, the processor 400 executes the selection module 445. The selection module 445, when executed by the processor 400, minimally causes the processor 400 to select 570 a primary taxi path from amongst one or more acceptable path descriptors stored in the path acceptance table 550. The selection of a primary taxi path is accomplished according to one or more operational parameters. According to this alternative embodiment, the selection module 445, when executed by the processor 400, minimally causes the processor 400 to receive an operational parameter 590. According to an alternative illustrative embodiment, the selection module 445 minimally causes the processor 400 to receive an operational parameter 590 from the on-board interface 415 included in this example embodiment of a dynamic path unit 405.

The selection module 445 minimally causes the processor 400 to compare a received operational parameter 590 to an acceptance threshold stored in the acceptance threshold field 565 of the acceptable path table 550. Such comparison is accomplished by the processor 400 according to the techniques and teachings of the present method. Accordingly, when executing the selection module 445, the processor 400 will receive an operational parameter 590 including at least one of aircraft position, aircraft speed, aircraft center of gravity, aircraft braking performance, aircraft weight, aircraft turning radius, aircraft touch-down position, turn angle of runway egress, surface condition of runway, surface condition of taxi way, airline directives, passenger comfort, visibility, weather and position of surface traffic.

A received operational parameter 590 is then compared against acceptance threshold for a particular taxi path by retrieving the acceptance threshold from an acceptable path descriptor with a corresponding operational parameter number stored in the operational parameter number field 560 included in the acceptable path descriptor. The selection module 445, when executed by the processor 400, further minimally causes the processor to convey 575 a primary path selection to the presentation module 450. In a like manner, one alternative example embodiment of the selection module 445 further minimally causes the processor 400 to select a secondary taxi path from amongst the acceptable path descriptors stored in the acceptable path table 550. According to one alternative embodiment the selection of a secondary taxi path selection is rendered by the processor 400 when a received operational parameter 590 changes to the extent that the primary taxi path selection becomes unacceptable. According to yet another alternative embodiment, the selection module 445, when executed by the processor 400, further minimally causes the processor 400 to provide an indication with respect to the availability of secondary taxi path selection. For example, the processor 400, as it executes the selection module 445, minimally generates a specific indicator when a secondary taxi path selection is not available. According to yet another example, no specific indicator is generated and the lack of a secondary taxi path selection is used to infer that no secondary taxi path selection is available.

One example embodiment of a dynamic taxi path unit 405 includes in the memory 420 a presentation module 450. The presentation module 450, when executed by the processor 400, minimally causes the processor 400 to direct 580 at least one of a primary taxi path selection and a secondary taxi path selection to the output interface 475. Accordingly, an egress selection message 480 is provided by the dynamic taxi path unit 405. According to yet another alternative embodiment, the presentation module 450, when executed by the processor 400, minimally causes the processor 400 to create a video image 585 which is stored in the video memory 465. The graphics engine 460 generates an output video signal 470 according to the video image stored in the video memory 565. The presentation module 450 of yet another alternative embodiment, when executed by the processor 400, further minimally causes the processor 400 to convey an indicator with respect to the availability of a secondary taxi path selection to at least one of the output interface 475 and the video memory 465. The video image, according to one alternate embodiment, is generated according to the location of a runway egress and a current aircraft position. This enables the generation of an image that can be superimposed with a forward field of view from the perspective of an aircraft pilot. Such an image can be used to drive a heads-up-display.

The functional processes (and their corresponding instruction sequences) described thus far that enable selection of a taxi path are, according to one embodiment, imparted onto computer readable medium. Examples of such medium include, but are not limited to, random access memory, read-only memory (ROM), compact disk (CD) ROM, digital versatile disk (DVD), floppy disks, and magnetic tape. This computer readable medium, which alone or in combination can constitute a stand-alone product, can be used to convert a general-purpose computing platform or an on-board computer on an aircraft into a device for selecting a taxi path according to the techniques and teachings presented herein. Accordingly, the claims appended hereto are to include such computer readable medium imparted with such instruction sequences that enable execution of the present method and all of the teachings afore described.

While the present method and apparatus has been described in terms of several alternative and exemplary embodiments, it is contemplated that alternatives, modifications, permutations, and equivalents thereof will become apparent to those skilled in the art upon a reading of the specification and study of the drawings. It is therefore intended that the true spirit and scope of the appended claims include all such alternatives, modifications, permutations, and equivalents.

What is claimed is:

1. A method for selecting a taxiway comprising:

providing an electronic system;

using the electronic system for:

determining a taxi destination;

determining one or more acceptable taxi-paths;

selecting as a primary taxi path one of the one or more acceptable taxi paths according to an operational parameter; and making available the selected primary taxi path;

wherein said step of determining one or more acceptable taxi paths comprises:

identifying an acceptable runway egress according to a taxi destination; and establishing an operational parameter acceptance threshold for a runway egress.

2. The method of claim 1 further comprising:

selecting a secondary taxi path when changes in operational parameters render the primary taxi path unacceptable; and making available the selected secondary taxi path.

3. The method of claim 1 further comprising providing an indication with respect to the availability of a secondary taxi path.

4. The method of claim 1 wherein selecting a primary path comprises selecting as a primary taxi path one of the one or more acceptable taxi paths according to at least one of aircraft position, aircraft speed, aircraft center of gravity, aircraft braking performance, aircraft weight, aircraft turning radius, aircraft touch-down position, turn angle of runway egress, surface condition of runway, surface condition of taxi way, airline directives, passenger comfort, visibility, weather and position of surface traffic.

5. The method of claim 1 wherein making available the selected primary taxi path comprises presenting information as an image coincident with a forward field of view.

6. A dynamic taxi path selection unit comprising:

a taxi destination receiver capable of receiving a taxi destination;

an acceptable path unit capable of receiving one or more available taxi paths and determining one or more acceptable taxi paths according to the taxi destination;

a taxi selection unit capable of selecting a primary taxi path from the one or more acceptable taxi paths; and an output interface capable of conveying a selected primary taxi path;

wherein the acceptable path unit is capable of receiving one or more runway egress specifications and is further capable of establishing an operational parameter acceptance threshold for said runway egress.

7. The taxi path selection unit of claim 6 wherein the taxi selection unit is further capable of selecting a secondary taxi path and the output interface is capable of conveying the selected secondary taxi path.

8. The taxi path selection unit of claim 6 wherein the taxi selection unit is capable of providing an indication with respect to the availability of a secondary taxi path selection and wherein the output interface is further capable of conveying said indicator.

9. The taxi path selection unit of claim 6 wherein the taxi selection unit is capable of selecting a taxi path according to at least one of aircraft position, aircraft speed, aircraft center of gravity, aircraft braking performance, aircraft weight, aircraft turning radius, aircraft touch-down position, turn angle of runway egress, surface condition of runway, surface condition of taxi way, airline directives, passenger comfort, visibility, weather and position of surface traffic.

10. The taxi path selection unit of claim 6 wherein the output interface comprises a heads up display.

11. A dynamic taxi path unit comprising:

a processor for executing instructions;

an on-board interface for communicating with an on-board device;

a memory for storing one or more instruction sequences;

an output interface for conveying a taxiway selection; and instruction sequences stored in the memory including:

a taxi destination module that, when executed by the processor, minimally causes the processor to receive a taxi destination using the on-board interface;

an acceptable path module that, when executed by the processor, minimally causes the processor to determine one or more acceptable taxi paths for the received taxi destination;

a selection module that, when executed by the processor, minimally causes the processor to select as a primary taxi path one of the one or more acceptable taxi paths according to an operational parameter; and a presentation module that, when executed by the processor, minimally causes the processor to direct a primary path selection to the output interface;

wherein the acceptable path module includes:

an egress identification module that, when executed by the processor, minimally causes the processor to identify an acceptable runway egress according to a taxi destination; and a threshold establishment module that, when executed by the processor, minimally causes the processor to establish an operational parameter acceptance threshold for an identified runway egress.

12. The dynamic taxi path unit of claim 11 wherein the selection module further minimally causes the processor to select a secondary taxi path when changes in an operational parameter render the primary taxi path unacceptable and wherein the presentation module further minimally causes the processor to direct the secondary selection path to the output interface.

13. The dynamic taxi path unit of claim 11 wherein the presentation module further minimally causes the processor to:

generate an indication with respect to the availability of a secondary taxi path selection; and direct the indication to the output interface.

14. The dynamic taxi path unit of claim 11 wherein the selection module causes the processor to minimally select a primary taxi path by minimally causing the processor to select as a primary taxi path one of the one or more acceptable taxi paths according to at lest one of aircraft position, aircraft speed, aircraft center of gravity, aircraft braking performance, aircraft weight, aircraft turning radius, aircraft touchdown position, turn angle of runway egress, surface condition of runway, surface condition of taxi way, airline directives, passenger comfort, visibility, weather and position of surface traffic.

15. The dynamic taxi path unit of claim 11 wherein the output interface comprises a graphics engine.

16. A computer readable medium having imparted thereon instruction sequences including:

a taxi destination module that, when executed by a processor, minimally causes the processor to receive a taxi destination;

an acceptable path module that, when executed by a processor, minimally causes the processor to determine one or more acceptable taxi paths for a received taxi destination;

a selection module that when executed by a processor, minimally causes the processor to select as a primary taxi path one of the one or more acceptable taxi paths according to an operational parameter; and a presentation module that, when executed by a processor, minimally causes the processor to direct a primary path selection to an output interface;

wherein the acceptable path module comprises:

an egress identification module that, when executed by the processor, minimally causes the processor to identify an acceptable runway egress according to a taxi destination; and a threshold establishment module that, when executed by the processor, minimally causes the processor to establish an operational parameter acceptance threshold for the identified runway egress.

17. The computer readable medium of claim 16 wherein the selection module further minimally causes a processor to select a secondary taxi path when changes in an operational parameter render the primary taxi path unacceptable and wherein the presentation module further minimally causes a processor to direct the secondary selection path to the output interface.

18. The computer readable medium of claim 16 wherein the presentation module further minimally causes the processor to:

generate an indication with respect to the availability of a secondary taxi path selection; and direct the indication to the output interface.

19. The computer readable medium of claim 16 wherein the selection module causes the processor to minimally select a primary taxi path by minimally causing the processor to select as a primary taxi path one of the one or more acceptable taxi paths according to at least one of aircraft position, aircraft speed, aircraft center of gravity, aircraft braking performance, aircraft weight, aircraft turning radius, aircraft touch-down position, turn angle of runway egress, surface condition of runway, surface condition of taxi way, airline directives, passenger comfort, visibility, weather and position of surface traffic.

20. The computer readable medium of claim 16 wherein the presentation module causes a processor to direct a primary path selection to a heads-up display.

* * * * *